US005102454A

United States Patent [19]

Johnson et al.

[11] Patent Number: 5,102,454

[45] Date of Patent: * Apr. 7, 1992

[54] HYDROMETALLURGICAL PROCESS FOR PRODUCING IRREGULAR SHAPED POWDERS WITH READILY OXIDIZABLE ALLOYING ELEMENTS

[75] Inventors: Walter A. Johnson, Towanda; Nelson E. Kopatz, Sayre; Joseph E. Ritsko, Towanda, all of Pa.

[73] Assignee: GTE Products Corporation, Stamford, Conn.

[ * ] Notice: The portion of the term of this patent subsequent to Sep. 20, 2005 has been disclaimed.

[21] Appl. No.: 303,076

[22] Filed: Jan. 30, 1989

Related U.S. Application Data

[63] Continuation of Ser. No. 140,374, Jan. 4, 1988, abandoned.

[51] Int. Cl.[5] ..... B22F 9/00

[52] U.S. Cl. ..... 75/765; 75/751

[58] Field of Search ..... 75/0.5, 246, 765, 751

[56] References Cited

U.S. PATENT DOCUMENTS

| | | | |
|---|---|---|---|
| 2,657,129 | 10/1963 | Stern et al. | 75/0.5 A |
| 2,665,981 | 1/1954 | Marquaire | 75/0.5 A |
| 2,735,757 | 2/1956 | Zapf | 75/0.5 |
| 3,652,259 | 3/1972 | Knopp | 75/0.5 B |
| 3,663,667 | 5/1972 | Cheney et al. | 264/14 |
| 3,909,241 | 9/1975 | Cheney et al. | 75/0.5 B |
| 3,974,245 | 9/1976 | Cheney et al. | 264/10 |
| 4,042,374 | 8/1977 | Rasmussen et al. | 75/0.5 B |
| 4,156,053 | 5/1979 | Baranow | 75/0.5 BC |
| 4,348,224 | 9/1982 | Gingerich et al. | 75/0.5 A |
| 4,397,682 | 8/1983 | Watanabe et al. | 75/0.5 A |
| 4,533,382 | 9/1985 | Miuara et al. | 75/0.5 C |
| 4,579,587 | 4/1986 | Grant et al. | 75/0.5 BB |
| 4,615,736 | 10/1986 | Armor et al. | 75/0.5 A |
| 4,670,047 | 6/1987 | Kopatz et al. | 75/0.5 B |
| 4,687,511 | 8/1987 | Paliwal et al. | 75/0.5 B |
| 4,731,110 | 3/1988 | Kopatz et al. | 75/0.5 A |
| 4,731,111 | 3/1988 | Kopatz et al. | 75/0.5 AB |
| 4,735,652 | 4/1988 | Johnson et al. | 75/0.5 A |
| 4,772,315 | 9/1988 | Johnson et al. | 75/0.5 AA |
| 4,778,515 | 10/1988 | Kemp, Jr. et al. | 75/0.5 BA |
| 4,783,215 | 10/1988 | Kemp, Jr. et al. | 75/0.5 B |
| 4,787,934 | 11/1988 | Johnson et al. | 75/0.5 AA |
| 4,792,351 | 12/1988 | Johnson et al. | 75/0.5 AA |
| 4,802,915 | 2/1989 | Kopatz et al. | 75/0.5 AA |

FOREIGN PATENT DOCUMENTS

| | | | |
|---|---|---|---|
| 0175824 | 4/1986 | European Pat. Off. | 75/0.5 A |
| 58-177402 | 10/1983 | Japan | 75/0.5 A |
| 0150828 | 8/1986 | Japan | 75/0.5 A |
| 1174301 | 8/1986 | Japan | 75/0.5 A |
| 0224076 | 8/1977 | U.S.S.R. | 75/0.5 A |

OTHER PUBLICATIONS

Hampel et al., "The Encyclopedia of Chemistry", 3rd Ed., p. 1042, (Van Nostrand Reinhold Company).

*Primary Examiner*—Wayne A. Langel
*Assistant Examiner*—Stephen Bos
*Attorney, Agent, or Firm*—James Theodosopoulos

[57] ABSTRACT

Composite powders containing a first group of metals of iron, cobalt, nickel and molybdenum in specific ratios and one or more oxidizable metals can be formed by forming an aqueous solution containing first group of metals, forming solid material of the metals from the solution, reducing the solid material to a metallic powder, combining that powder with one or more easily oxidizable metals in an non-oxidizing atmosphere.

11 Claims, No Drawings

HYDROMETALLURGICAL PROCESS FOR PRODUCING IRREGULAR SHAPED POWDERS WITH READILY OXIDIZABLE ALLOYING ELEMENTS

This application is a continuation of application Ser. No. 140,374, filed Jan. 4, 1988, now abandoned.

CROSS REFERENCE TO RELATED APPLICATIONS

This invention is related to the following applications: Ser. No. 054,557, filed 5/27/87, entitled, "Hydrometallurgical Process For Producing Finely Divided Spherical Metal Alloy Powders"; U.S. Pat. No. 4,731,111, issued Mar. 15, 1988, Ser. No. 026,312, filed 3/16/87, entitled, "Hydrometallurgical Process for Producing Finely Divided Spherical Refractory Metal Alloy Powders"; U.S. Pat. No. 4,723,993, issued Feb. 9, 1988, Ser. No. 028,824, filed 3/23/87, entitled, "Hydrometallurgical Process For Producing Finely Divided Spherical Low Melting Temperature Powders"; U.S. Pat. No. 4,731,110, issued Mar. 15, 1988, Ser. No. 026,222, filed 3/16/87, entitled, "Hydrometallurgical Process for Producing Finely Divided Spherical Precious Metal Alloy Powders"; U.S. Pat. No. 4,778,517, issued Oct. 18, 1988, Ser. No. 054,553, filed 5/27/87, entitled, "Hydrometallurgical Process For Producing Finely Divided Copper and Copper Alloy Powders"; Ser. No. 054,479, filed 5/27/87, entitled "Hydrometallurgical Process For Producing Finely Divided Iron Based Powders", all of which are by the same inventors as this application and assigned to the same assignee.

This invention is related to the following applications: U.S. Pat. No. 4,792,351 issued Dec. 20, 1988, entitled "Hydrometallurgical Process For Producing Irregular Morphology Powders"; U.S. Ser. No. 140,374, entitled, "Hydrometallurgical Process For Producing Finely Divided Spherical Maraging Steel Powders"; U.S. Pat. No. 4,859,237, issued Aug. 22, 1989, entitled "Hydrometallurgical Process For Producing Spherical Maraging Steel Powders With Readily Oxidizable Alloying Elements"; and U.S. Pat. No. 4,781,934, issued Nov. 29, 1988, entitled "Hydrometallurgical Process for Producing Spherical Maraging Steel Powders Utilizing Pre-Alloyed Spherical Powder and Elemental Oxidizable Species"; and U.S. Pat. No. 4,772,315, issued Sept. 20, 1988, entitled "Hydrometallurgical Process For Producing Finely Divided Spherical Maraging Steel Powders Pre-Alloyed Containing Readily Oxidizable Alloying Elements", all of which are filed concurrently herewith and all of which are by the same inventors and assigned to the same assignee as the present application.

FIELD OF THE INVENTION

This invention relates to the preparation of irregular morphology powder containing readily oxidizable elements which can be converted to maraging steels. More paraticularly it relates to the production of such powders by a hydrometallurgical process.

BACKGROUND OF THE INVENTION

Maraging steel is a term of the art derived from "martensite age hardening". These alloys are currently the iron- nickel-cobalt-molybdenum alloys as described in the cobalt monograph series entiltled "Cobalt-containing high strenth steels", Centre D'Information Du Cobalt, Brussels, 1974, pp. 50-51. Readily oxidizable metals such as Al, V and/or Ti at low levels e.g. 1% by weight or below can be added.

Metal alloy powders heretofore have been produced by gas or water atomization of molten ingots of the alloy. It has not been generally practical to produce the metal alloy powders directly from the individual metal powders because of the difficulty in obtaining uniformity of distribution of the metals. It is difficult to obtain certain powders containing readily oxidizable metals such as aluminum because of the tendency of those metals to form the respective oxides during processing.

U.S Pat. No. 3,663,667 discloses a process for producing multimetal alloy powders. Thus, multimetal alloy powders are produced by a process wherein an aqueous solution of at least two thermally reducible metallic compounds and water is formed, the solution is atomized into droplets having a droplet size below about 150 microns in a chamber that contains a heated gas whereby discrete solid particles are formed and the particles are thereafter heated in a reducing atmosphere and at temperatures from those sufficient to reduce said metallic compounds to temperatures below the melting point of any of the metals in said alloy.

It is believed therefore that a relatively simple process which enables finely divided powders to be produced from sources of the individual metals to produce a Fe-Ni-Co-Mo composite particles to which may subsequently be added appropriate amounts of titanium and aluminum which can be coverted to maraging steels is an advancement in the art.

SUMMARY OF THE INVENTION

In accordance with one aspect of this invention there is provided a process comprising forming an aqueous solution containing the metal values of iron, cobalt, nickel and molybdenum in a predetermined ratio, forming a reducible solid material from the solution, reducing the material to form metallic powder particles, and combining the metallic powder particles with a predetermined amount of particles of at least one readily oxidizable metal selected from the group consisting of aluminum, titanium and vanadium to form a relative uniform blend of irregular shaped particles.

DETAILS OF THE PREFERRED EMBODIMENTS

For a better understanding of the present invention, together with other and further objects, advantages, and capabilities thereof, reference is made to the following disclosure and appended claims in connection with the foregoing description of some of the aspects of the invention.

While it is preferred to use metal powders as starting materials in the practice of this invention because such materials dissolve more readily than other forms of metals, however, use of the powders is not essential. Metallic salts that are soluble in water or in an aqueous mineral acid can be used. When alloys are desired, the metallic ratio of the various metals in the subsequently formed solids of the salts, oxides or hydroxides can be calculated based upon the raw material input or the solid can be sampled and analyzed for the metal ratio in the case of alloys being produced. The metal values can be dissolved in any water soluble acid. The acids can include the mineral acids, such as hydrochloric, sulfuric and nitric, as well as the organic acids such as acetic, formic and the like. Hydrochloric is especially preferred because of cost and availability.

After the metal sources are dissolved in the aqueous acid solution, the resulting solution can be subjected to sufficient heat to evaporate water. The metal compounds, for example, the oxides, hydroxides, sulfates, nitrates, chlorides, and the like, will precipitate from the solution under certain pH conditions. The solid materials can be separated from the resulting aqueous phase or the evaporation can be continued. Continued evaporation results in forming particles of a residue consisting of the metallic compounds. In some instances, when the evaporation is done in air, the metal compounds may be the hydroxides, oxides or mixtures of the mineral acid salts of the metals and the metal hydroxides or oxides. The residue may be agglomerated and contain oversized particles. The average particle size of the materials can be reduced in size by milling, grinding or by other conventional methods of particle size reduction.

After the particles are reduced to the desired size they are heated in a reducing atmosphere at a temperature above the reducing temperature of the salts but below the melting point of the metals in the particles. The temperature is sufficient to evolve any water of hydration and the anion. If hydrochloric acid is used and there is water of hydration present, the resulting wet hydrochloric acid evolution is very corrosive thus appropriate materials of construction must be used. The temperatures employed are below the melting point of any of the metals therein but sufficiently high to reduce and leave only the cation portion of the original molecule. In most instances a temperature of at least about 500° C. is required to reduce the compounds. Temperatures below about 500° C. can cause insufficient reduction while temperatures above the melting point of the metal result in large fused agglomerates. If more than one metal is present the metals in the resulting multimetal particles can either be combined as intermetallics or as solid solutions of the various metal components. In any event there is a homogenous distribution throughout each particle of each of the metals. The particles are generally irregular in shape. If agglomeration has occurred during the reduction step, particle size reduction by conventional milling, grinding and the like can be done to achieve a desired average particle size for example less than about 20 micrometers with at least 50% being below about 20 micrometers.

After the irregular shaped powders containing the desired levels of iron-cobalt-nickel and molybdenum are reduced to the desired size, they are combined with a predetermined amount of at least one readily oxidizable metal selected from the group consisting of aluminum, titanium and vanadium to form a uniform blend. Conventional blending by utilizing similar particle sizes of the materials can be used. Agglomerates can be formed by the techniques described in U.S. Pat. Nos. 3,974,245 and 3,617,358 which are incorporated by reference herein. Spray drying is the preferred technique of agglomeration of the Fe-Co-Ni-Mo materials with one or more of the readily oxidizable metals of Ti, V and Al. Spray drying must be conducted in a non-oxidizing atmosphere to prevent the readily oxidizable metal from being converted to the oxide.

EXAMPLE

About 670 parts of iron powder and about 180 parts of nickel powder and about 100 parts of cobalt are dissolved in about 4000 parts of 10 N HCl using a glass lined agitated reactor. About 50 parts of molybdenum as a solution of ammonium molybdate are added to the above solution.

Ammonium hydroxide is added to a pH of about 6.5–7.5. The iron, nickel, cobalt and molybdenum are precipitated as an intimate mixture of hydroxides. This mixture is then evaporated to dryness. The mixture is then heated to about 350° C. in air for about 3 hours to remove the excess ammonium chloride. This mixture is then hammermilled to produce a powder having a greater than 50% of the particles larger than about 50 micrometers with no particles larger than about 100 micrometers. These milled particles are heated in a reducing atmosphere of $H_2$ at a temperature of about 750° C. for about 3 hours. Finely divided particles containing 67% iron, 18% nickel, 10% cobalt and 5% molybdenum are formed. About 0.5 parts of aluminum powder and about 0.5 parts of titanium metal powders having essentially the same particle size as the iron-nickel-cobalt-molybdenum are blended with about 99 parts of the Fe-Ni-Co-Mo powder for a sufficient time to yield a uniform powder blend. The powder, upon solid state sintering in a non-oxidizing atmosphere, is coverted to a maraging steel containing the readily oxidizable metals of aluminum and titanium.

While there has been shown and described what are considered the preferred embodiments of the invention, it will be obvious to those skilled in the art that various changes and modifications may be made therein without departing from the scope of the invention as defined by the appended claims.

What is claimed is:

1. A process for producing an aggomerated maraging steel powder comprising densified particles and readily oxidizable metal particles, said densified particles having a desirable composition consisting essentially of a wherein said alloy consists essentially of form about 5% to about 20% by weight of cobalt, from about 5% to about 20% by weight of nickel, from about 1% to about 14% by weight of molybdenum, and the balance iron, said process comprising:

a) forming an aqueous solution containing the metal values of iron, cobalt, nickel and molybdenum, said metals being present in a predetermined ratio for forming said densified particles having said desirable composition, said solution comprising a mineral acid, b) forming from said solution a reducible solid material selected from the group consisting of salts of said metals, hydroxides of said metals and mixtures, thereof, said reducible solid material being formed by adjusting the pH of said solution to form a solid precipitate, and separating said reducible solid material from said solid precipitate, c) reducing said reducible solid material at a temperature above the reduction temperature but below the melting point of any of said metals in said reducible solid material to form metallic powder particles consisting essentially of iron, cobalt, nickel, and molybdenum in said predetermined ratio in an unalloyed form and, d) combining by spray drying said metallic powder particles with a predetermined amount of at least one radially oxidizable metal selected from the group consisting of aluminum, titanium and vanadium to form a relatively uniform blend of irregular shaped agglomerated particles, said predetermined amount being about 1 percent or less by weight based on the combined weight of said metallic powder particles and said readily oxidizable metal, e) sintering said blend to converted to a maraging steel alloy thereby producing a maraging steel powder having desirable composition comprising densified particles and readily oxidizable metal particles.

2. A process according to claim 1 wherein said solution contains a mineral acid selected from the group consisting of hydrochloric, sulfuric and nitric acids.

3. A process according to claim 2 wherein said mineral acid is hydrochloric acid.

4. A process according to claim 1 wherein said aqueous solution contains a water soluble acid.

5. A process according to claim 2 wherein said reducible solid material is formed by evaporation of the water from the solution.

6. A process according to claim 2 wherein said reducible solid material is formed by adjusting the pH of the solution to form a solid which is separated from the resulting aqueous phase.

7. A process according to claim 1 wherein said combining is achieved by blending.

8. A process according to claim 1 wherein said combining is achieved by agglomerating.

9. A process according to claim 1 wherein said material produced by step (b) is subjected to a particle size reduction step prior to the reduction step (c).

10. A process according to claim 1 wherein the powder particles from step (c) are subjected to a particle size reduction step prior to the combining step (d).

11. A process according to claim 1 wherein at least 50% of said metallic powder particles that are combined with the particles of at least one readily oxidizable metal in step (d) have a size less than about 20 micrometers.

* * * * *